US005806720A

United States Patent [19]

Zook

[11] Patent Number: 5,806,720

[45] Date of Patent: Sep. 15, 1998

[54] MULTI POSITION PALLETIZER HEAD FOR ADHESIVE SUPPLY UNIT

[75] Inventor: Jon C. Zook, Hendersonville, Tenn.

[73] Assignee: Illinois Tool Works Inc., Glenview, Ill.

[21] Appl. No.: 683,902

[22] Filed: Jul. 19, 1996

[51] Int. Cl.[6] ..... B05B 1/00

[52] U.S. Cl. ..... 222/146.5; 222/330; 222/567; 239/391; 239/397; 239/442

[58] Field of Search ..... 222/146.5, 330, 222/331, 567; 239/391, 397, 442

[56] References Cited

U.S. PATENT DOCUMENTS 2,069,667 2/1937 Clawson ..... 239/391
5,335,825 8/1994 Fort ..... 222/330 X
5,487,507 1/1996 McDonald et al. ..... 239/391

*Primary Examiner*—Kenneth Bomberg
*Attorney, Agent, or Firm*—Dvorak & Orum

[57] ABSTRACT

An adhesive supply unit used in palletizing applications having a multipositional head consisting of a module, service block, and head. Initially, the head is fastened to the service block forming a single head and service block unit. The head and service block unit may then be fastened to the adhesive supply unit in at least two ways at the lower module of the module. In one embodiment, the head and service block unit are vertically attached to the lower module so as to produce an adhesive swirl spray pattern. In another embodiment, the head and service block unit are horizontally attached to the lower module so as to produce an adhesive bead pattern.

10 Claims, 2 Drawing Sheets

MULTI POSITION PALLETIZER HEAD FOR ADHESIVE SUPPLY UNIT

BACKGROUND OF THE INVENTION

1. Field of the Invention

This invention relates to a multipositional apparatus used in conjunction with an adhesive supply unit for dispensing thermoplastic adhesive in a plurality of patterns onto a variety of containers to be palletized.

2. Description of the Prior Art

In the known art, thermoplastic adhesive modules and attached nozzles are fixedly connected to adhesive supply unit in a horizontal position. Prior art nozzles do not allow for a variation in position. The nozzles in this position dispense thermoplastic adhesive, or hot melt, in a bead pattern. The current invention improves upon and overcomes the limitations of the prior art. By allowing for the quick and easy changeover from a horizontal position which dispenses thermoplastic adhesive only in a bead pattern to a vertical position for dispensing thermoplastic adhesive in a sinusoidal pattern.

SUMMARY OF THE INVENTION

The nature of the invention is in the ease in which the module changes over from a horizontal position, or first position, to a vertical position, or second position, without the need for a change in parts except for the positioning of the service housing itself.

One of the principle objects of this invention is to facilitate the changeover from a horizontal to a vertical spray configuration. A further object of the invention is to increase pallet load stabilization by applying thermoplastic adhesive in a sinusoidal pattern to containers.

A further object of this invention is to decrease costs involved in palletizing containers by using an application of thermoplastic adhesive in a sinusoidal position rather than costly stretch wrap and/or netting.

A further object of this invention is to promote safety by the increased stability of loads that are palletized using thermoplastic adhesive applied in a sinusoidal pattern.

DESCRIPTION OF THE PREFERRED EMBODIMENT

Figure 1:
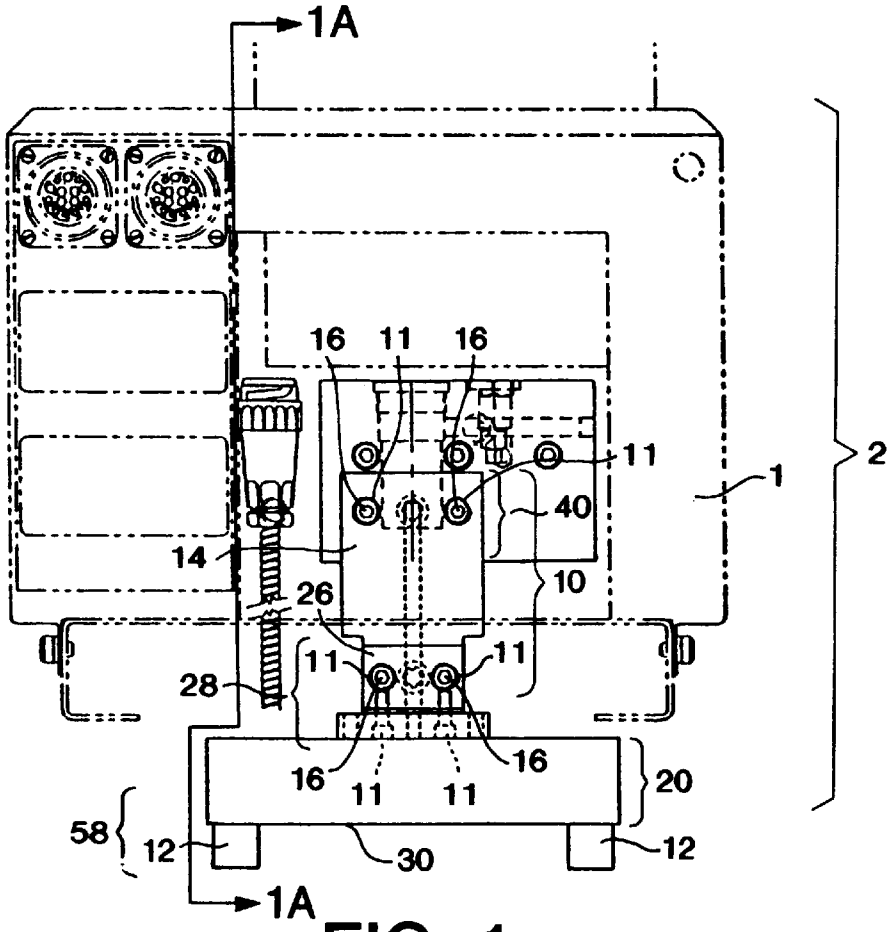
FIG. 1 is a frontal view of the adhesive supply unit with the service block in a horizontal position for adhesive bead pattern formation.

FIG. 1 illustrates one of the several possible embodiments of the multipositional apparatus 2 contemplated by this invention.

As shown in FIG. 1, the manifold 10 with a plurality of attachment apertures 11 is connected to the adhesive supply unit 1 used for heating and containing the thermoplastic adhesive prior to being dispensed upon the containers at the upper manifold portion 14 of the manifold 10 by a manifold attachment means 40. The manifold 10 functions as a mechanism to which all of the various parts of the multipositional apparatus 2 are attached.

As shown in FIG. 1, in one embodiment, the manifold attachment means 40, consists of at least one bolt 16 for securing the manifold 10 to the adhesive supply unit 1. The bolt 16 is inserted into at least one of the attachment apertures 11 located at the upper manifold portion 14. The bolt 16 is then attached to the adhesive supply unit via conventional means.

In the first position, as shown in FIG. 1, the manifold 10 is removably attached to the service housing 20 by a multipositional attachment means 28. The service housing 20 provides an adhesive port, air pressure, and electrical power to the module.

Figure 2:
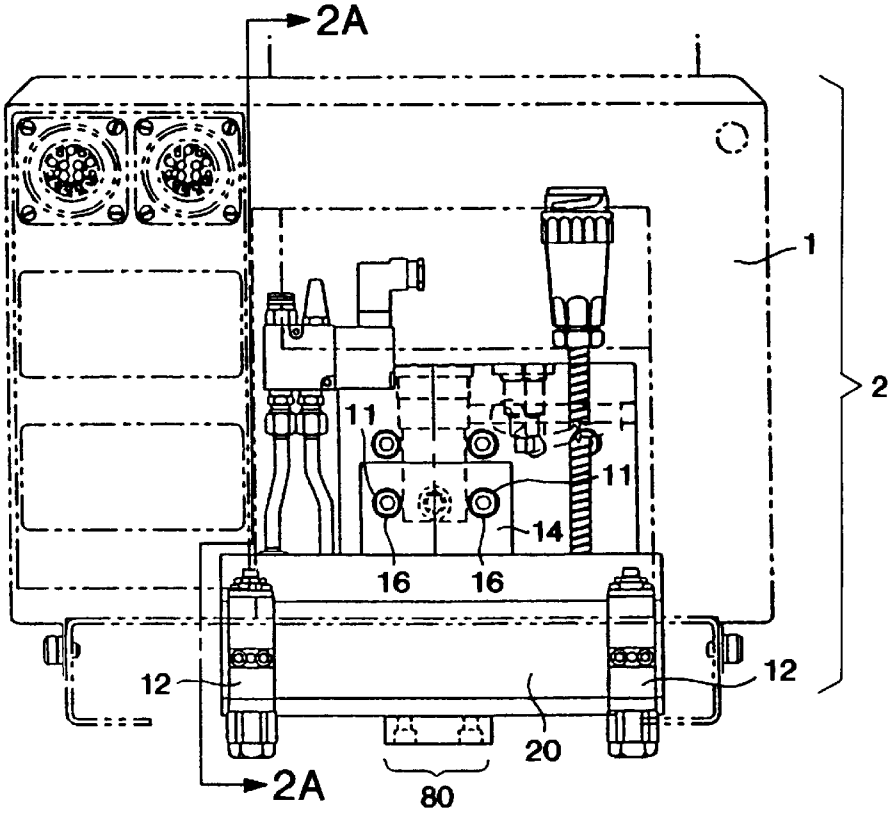
FIG. 2 is a frontal view of the adhesive supply unit with the service block in a vertical position for thermoplastic adhesive sinusoidal pattern formation.

As shown in FIG. 1, the multipositional attachment means 28, when in the second position may comprise at least one bolt 16 which secures the service housing 20 to the manifold 10. At least one bolt 16 is inserted into at least attachment aperture 11 at the front portion 26 of the manifold 10. The bolt 16 is then attached to the service housing 20 via conventional means. The service housing 20, when attached to the front portion 26 of the manifold 10, as shown in FIG. 2, is attached in the second position, to dispense sinusoidal spray.

As shown in FIG. 1, when in the first position, the service housing 20 is in a horizontal position and dispenses thermoplastic adhesive in a bead pattern. As shown in FIG. 2, when in the second position, the service housing is in a vertical position and dispenses thermoplastic adhesive in a sinusoidal pattern.

The module 12 is removably mounted to the front wall 30 of the service housing 20 by a module attachment means 58 via conventional methods.

Figure 1A:
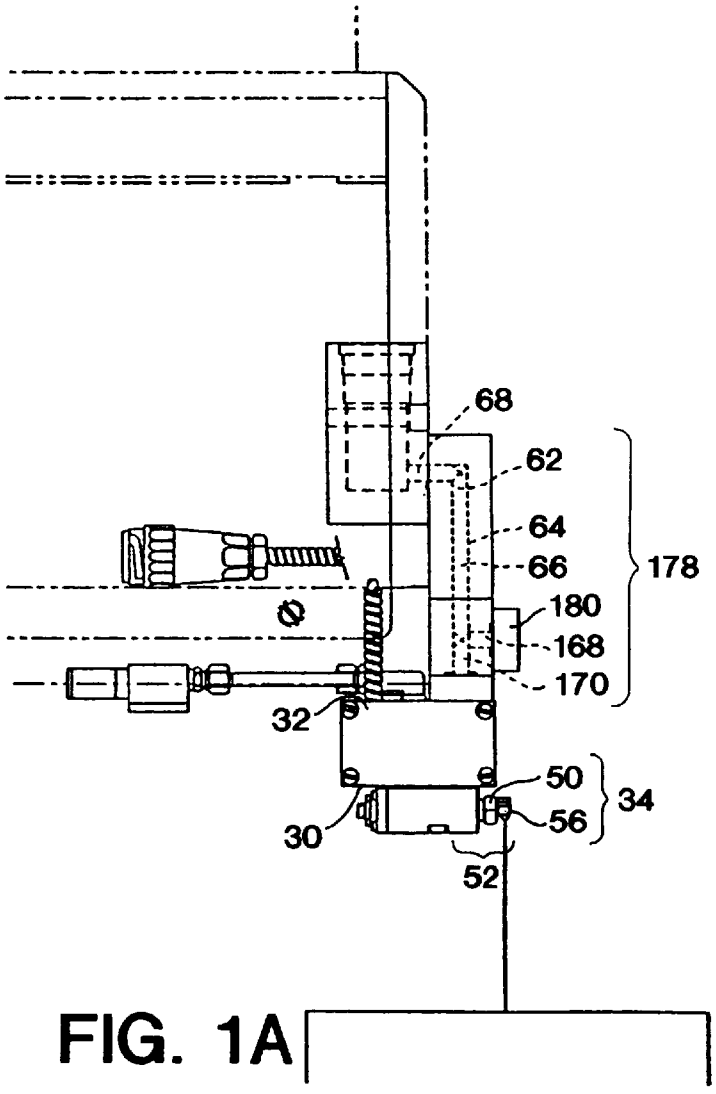
Figure 1*a* is a side view along line 1*a*—1*a* of the adhesive supply unit with the service block in the horizontal position wherein a portion of the housing is removed for clarity, with the remainder shown in fantom.

A nozzle 34, which produces a plurality of thermoplastic adhesive patterns, as shown in Figure 1*a*, is removably attached to the lower portion 50 of the module 12 by a nozzle attachment means 52. A second tip attachment 54 is removably attached to the nozzle and produces a sinusoidal pattern of thermoplastic adhesive while in the second position. Further, a first tip attachment 56 is removably attached to the nozzle 34 and produces a bead pattern of thermoplastic adhesive while in the first position.

As shown in Figure 1*a*, in one embodiment, an adhesive port 178 is positioned vertically in the manifold 10. The adhesive port 178 consists of an upper portion 62, a body 64. and a lower portion 66. The lower portion 66 branches into a side outlet 168 and a lower outlet 170. The upper portion 62 of the adhesive supply 1 unit is cooperative with an inlet 68 to the adhesive port 178.

The multipositional attachment means 28, when in the first position may comprise at least one bolt 16 which secures the service housing to the manifold 10. At least one bolt 16 is inserted into at least one attachment aperture 11 at the bottom portion 80 of the manifold 10. The bolt 16 is then attached to the service housing 20 via conventional means. The service housing 20, when attached to the bottom portion 80 of the manifold 10, as shown in FIG. 1, is attached in the first position, in order to dispense bead spray.

As shown in Figure 1*a*, in one embodiment, when in use, in the first position, the service housing 20 is mounted to the lower outlet 170 via conventional mounting means. In this configuration, the side outlet 168 of the adhesive port 178, which is not in use, is blocked off with a blocking means 180. The blocking means 180 may consist of a blocking plate 182. In this configuration, the thermoplastic adhesive dispersed from the nozzle 34 is in a bead pattern.

Figure 2A:
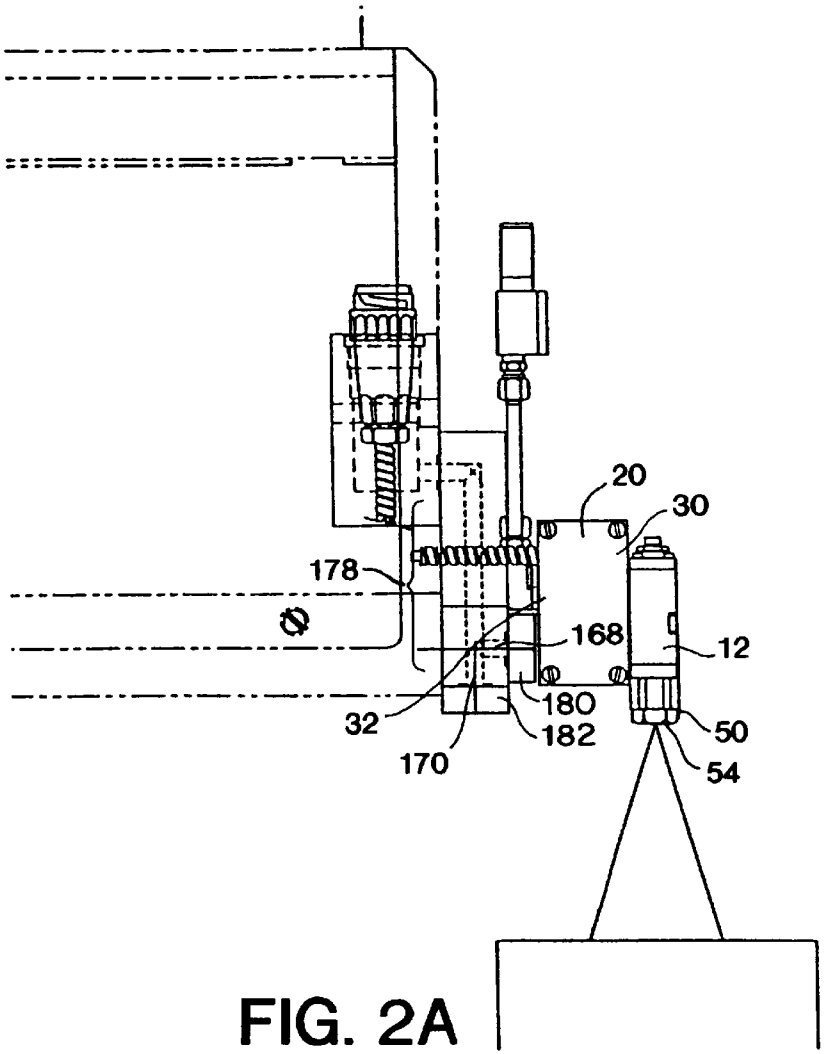
FIG. 2*a* is a side view along line 2*a*—2*a* of the adhesive supply unit with the service block in the vertical position wherein a portion of the housing is removed for clarity, with the remainder shown in fantom.

As shown in FIG. 2*a*, in one embodiment, when in use, in the second position, the service housing 20 is mounted to the side outlet 168 via conventional means. The lower outlet 170 is blocked by a blocking means 180. As shown in FIG. 2, in one embodiment of the invention, the blocking means consists of a blocking plate 182.

Other variations of this invention are contemplated by this application, and the scope of the invention is to be limited only by the following claims.

I claim:

1. A multipositional apparatus, used in the palletization of containers, the apparatus for dispensing a thermoplastic adhesive, comprising:

an adhesive supply unit for heating and containing the thermoplastic adhesive prior to being dispensed upon the containers;

a manifold which includes a multipositional attachment means attached thereto, said manifold including a plurality of attachment apertures used for connecting the manifold to a service housing and the adhesive supply unit;

a manifold attachment means for attaching the manifold to the adhesive supply unit and the service housing;

at least one module for dispensing the thermoplastic adhesive and at least one nozzle removably attached to said at least one module, said at least one nozzle for producing a plurality of sprayed thermoplastic adhesive patterns;

a module attachment means for removably mounting the module to the service housing;

said service housing movable between a first position and a second position on the manifold multipositional attachment means; and nozzle attachment means for removably attaching the at least one nozzle to the module, wherein the service housing can be expediently moved between the first and second position for dispensing the thermoplastic adhesive onto the containers to be palletized, said adhesive dispensed in at least one of said plurality of sprayed patterns.

2. The multipositional apparatus of claim 1 wherein the at least one nozzle of said service housing includes a first tip attachment removably attached to the at least one nozzle for producing a bead pattern of the thermoplastic adhesive when said service housing is in said first and horizontal position.

3. The multipositional apparatus of claim 1 wherein the at least one nozzle of said service housing includes a second tip attachment removably attached to the at least one nozzle for producing a sinusoidal pattern of the thermoplastic adhesive when said service housing is in said second and vertical position.

4. The multipositional apparatus of claim 1 wherein the manifold attachment means comprises at least one fastening member for removably securing the manifold to the adhesive supply unit and the fastening member is insertable into one of said plurality of attachment aperture located at an upper portion of the manifold.

5. The multipositional apparatus of claim 1 wherein the multipositional attachment means comprises at least one fastening means for removably securing the service housing to the manifold while in the second position and the fastening means is insertable into one of said plurality of attachment aperture located at a front portion of the manifold.

6. The multipositional apparatus of claim 1 wherein the multipositional attachment means comprises at least one fastening member for removably securing the service housing to the manifold while in the first position and the fastening member is insertable into one of said plurality of attachment aperture located at a bottom portion of the manifold.

7. The multipositional apparatus of claim 1 wherein the manifold further comprises an adhesive port located within the manifold, the adhesive port including a body having an upper portion and a lower portion, the upper portion having an inlet cooperative with the adhesive supply unit, the lower portion having a side outlet and a lower outlet.

8. The multipositional apparatus of claim 7 wherein the service housing is mounted to the lower outlet of the manifold when in the first position and wherein a blocking means is mounted to the side outlet of the manifold when in the first position.

9. The multipositional apparatus of claim 7 wherein the service housing is mounted to the side outlet of the manifold in the second position and wherein a blocking means is mounted to the lower outlet of the manifold when in the second position.

10. The multipositional apparatus of claim 9 wherein the blocking means comprises a blocking plate.

* * * * *